US006481016B1

(12) United States Patent
Rees

(10) Patent No.: US 6,481,016 B1
(45) Date of Patent: Nov. 19, 2002

(54) BABY BIB

(75) Inventor: Arnold Edward Rees, Newcastle-Upon-Tyne (GB)

(73) Assignee: Jackel International Limited (GB)

( * ) Notice: Subject to any disclaimer, the term of this patent is extended or adjusted under 35 U.S.C. 154(b) by 0 days.

(21) Appl. No.: 09/700,661

(22) PCT Filed: May 25, 1999

(86) PCT No.: PCT/GB99/01640

§ 371 (c)(1), (2), (4) Date: Nov. 17, 2000

(87) PCT Pub. No.: WO99/60876

PCT Pub. Date: Dec. 2, 1999

(30) Foreign Application Priority Data

May 26, 1998 (GB) ..... 9811300

(51) Int. Cl.[7] ..... A61B 13/10
(52) U.S. Cl. ..... 2/49.1; 2/49.2
(58) Field of Search ..... 2/49.1, 49.2, 52, 2/50, 48, 51, 49.3, 49.4, 46, 468, 129, 104, 111, 75, 80

(56) References Cited

U.S. PATENT DOCUMENTS

| | | | | | |
|---|---|---|---|---|---|
| 1,974,237 | A | * | 9/1934 | Eidinger | 2/50 |
| 2,116,685 | A | * | 5/1938 | Nicolet | 2/50 |
| 2,884,638 | A | * | 5/1959 | Ream | 2/49 |
| 3,067,428 | A | * | 12/1962 | Baker et al. | 2/52 |
| 4,615,047 | A | * | 10/1986 | Matsuoka | 2/50 |
| 5,146,629 | A | * | 9/1992 | Barnes | 2/50 |
| 5,432,952 | A | * | 7/1995 | Tate | 2/49.4 |
| 5,469,580 | A | * | 11/1995 | Sobol | 2/49.4 |
| 5,490,289 | A | * | 2/1996 | Lehrer | 2/49.4 |
| 5,666,665 | A | * | 9/1997 | Morgado | 2/49.1 |
| 6,125,471 | A | * | 10/2000 | Gupta et al. | 2/52 |
| 6,363,530 | B1 | * | 4/2002 | Lampson et al. | 2/49.1 |

* cited by examiner

*Primary Examiner*—Amy B. Vanatta
(74) *Attorney, Agent, or Firm*—Larson & Taylor, PLC

(57) ABSTRACT

A baby's bib comprises a body portion (2) of a semi-rigid plastics material in which is formed an opening (14) for the baby's neck, a bead (16) of a plastics material softer than that of the body portion (2) being secured around part at least of the opening (14), the attachment of the bead (16) to the body portion (2) being such as to permit radial compression of the bead (16) but to prevent longitudinal extension of the bead (16).

4 Claims, 1 Drawing Sheet

BABY BIB

FIELD OF THE INVENTION

This invention relates to bibs for babies, and has particular, although not exclusive, application to plastic baby bibs which incorporate spillage scoops at the bottom thereof.

BACKGROUND OF THE INVENTION

It is conventional practice to provide bibs to protect the clothing of babies or young children which are moulded from a semi-rigid plastics material such as polyethylene or polypropylene, and which incorporate integrally formed spillage collection scoops at the lower regions thereof.

Such bibs are conventionally manufactured by injection moulding techniques utilizing two mould halves one to the front of the bib and one to the rear of the bib.

The mould defines a neck opening and a neck band to the bib the edges of which are at the junction of the two mould halves. As a consequence these edges tend to be relatively sharp, and it is necessary to machine or treat the edges, for example by cutting with a sharp knife, to smooth them down.

Clearly such a procedure adds to the cost and complexity of manufacture.

In use of a bib, the opposed ends of the neck band are releasably secured together at the back of the neck of the baby to retain the bib in position.

The semi-rigid nature of the material of the bib, and the requirement for the bib to be fastened reasonably tightly round the baby's neck to prevent spillage inside the bib, tend to result in discomfort to the neck of the baby. This discomfort is compounded by the wriggling movement and the like commonly associated with the feeding of young babies and which can result in the edge of the neck band pressing against the baby's neck. Even though these edges are relatively smooth, the relatively rigid nature of the material can cause the bib to dig into the baby's neck.

U.S. Pat. No. 5,490,298 discloses a baby's bib in which the neck opening of the bib is provided with a cushioned and resilient liner edge comprising a laminate stitched about the neck opening.

It would be desirable to be able to provide a baby's bib that was cheap and easy to manufacture and which was more comfortable to wear than the current products.

SUMMARY OF THE INVENTION

According to the present invention there is provided a baby's bib comprising a body portion of a plastics material having an opening to receive the baby's neck, a bead of a plastics material more compressible than that of the body portion being moulded around the defining edge of the opening to be integral with the body portion, and, in use to encircle the neck of the baby, the bead being such as to permit compression of the more compressible plastic material thereof in a direction substantially radially of the bead but to prevent extension of the more compressible material in a direction along the length of the bead.

It will be appreciated that the presence of the softer, more compressible plastics material in contact with the baby's neck serves to reduce the discomfort that would otherwise exist.

The upper regions of the opening in the body portion may be defined by a pair of strap portions extending from opposed sides of the body portion and adapted to be secured together behind the neck of the baby to retain the bib thereon, the side edges of said strap portions which define said opening comprising said more compressible plastics material.

Preferably the body portion of the bib is of polyethylene or polypropylene and the softer plastics material is a thermoplastic elastomer.

The invention is particularly applicable to bibs the body portions of which include integrally moulded spillage collection scoops at the lower regions thereof.

BRIEF DESCRIPTION OF THE FIGURES

By way of example only, an embodiment of the invention will now be described in greater detail with reference to the accompanying drawings wherein.

DESCRIPTION OF PREFERRED EMBODIMENTS

Figure 1:
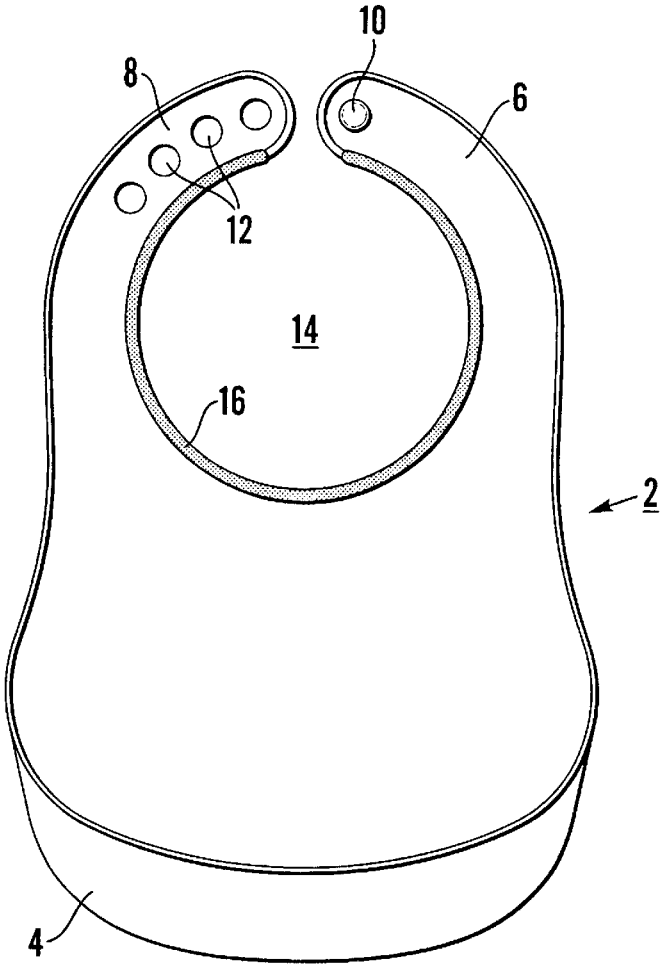
FIG. 1 is a front view of a bib according to the invention.
Figure 2:
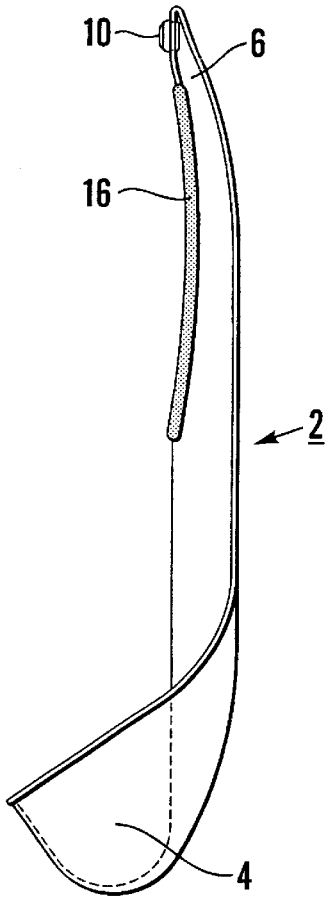
FIG. 2 is a side view of the bib in FIG. 1

Referring to FIGS. 1 and 2, the illustrated bib comprises a body portion indicated generally at 2 and moulded from a semi-rigid plastics material, such as polyethylene or polypropylene. Integrally moulded with the body portion 2 are a spillage collection scoop 4 of conventional form and a pair of straps 6,8 on one of which is formed a stud 10 and in the other of which is formed a series of apertures 12, to receive said stud and to effect adjustable fastening of the bib around a baby's neck.

The edge of the upper central regions of the body portion 2, together with the inner edges of the straps 6,8, define a substantially circular opening 14 in the bib to receive therein the baby's neck.

A prime feature of the invention is the provision of a bead 16 of a soft plastics material, for example a thermoplastic elastomer, around the bounding edge of the opening 14 as clearly shown in FIG. 1, this soft material engaging the baby's neck and providing, in use, a level of comfort not available from the prior art bibs.

More particularly, the bead 16 is moulded to the body portion 2 and to the straps 6,8 such that the soft material of the bead 16 and the semi-rigid material of the body portion 2 and straps 6,8 bond together to integrate the components, thereby to prevent the ingress of spilled food between the two materials.

As the bead 16 is integral with the body portion, the bead 16 cannot stretch or extend in a direction along the length of the bead 16, but is compressible when subjected to radial forces such as will be triggered by the wriggling and other movements associated with a baby being fed. The soft, giving nature of the material of the bib provides a much more comfortable experience for the baby than heretofore, while, once molded, there is no need for any further treatment to the bib to ensure comfort to the user.

Clearly the precise construction of the bib can vary from that described and illustrated. For example, the bead 16 may extend around part only of the defining edge of the opening 14, typically that part engaging the front of the baby's neck, while the soft material may be of greater thickness than that shown. The invention is applicable to bibs that do not incorporate spillage scoops 4. Other modifications and variations will be apparent to those skilled in the art.

What is claimed is:

1. A baby's bib comprising:

a body portion of a first plastic material having an opening to receive a baby's neck; and a bead formed of a second plastic material more compressible than that of the first plastic material and moulded around a defining edge of the opening to be integral with the body portion and, in use, to encircle the neck of the baby, the bead being such as to permit compression of the second plastic material in a direction substantially radially of the bead but to prevent extension of the second plastic material in a direction along the length of the bead.

2. The bib of claim 1 wherein upper regions of the opening in the body portion are defined by a pair of strap portions extending from opposed sides of the body portion and adapted to be secured together behind the neck of the baby to retain the bib thereon, the side edges of said strap portions which define said opening comprising the second plastic material.

3. The bib of claim 1 wherein the first plastic material is made of polyethylene or polypropylene, and the second plastic material is a thermoplastic elastomer.

4. The bib of claim 1 wherein the body portion thereof includes an integrally moulded spillage scoop at the lower regions thereof.

* * * * *